United States Patent [19]

Okagaki

[11] Patent Number: 5,070,472

[45] Date of Patent: Dec. 3, 1991

[54] CONVOLVER OPTIMUM BIAS CIRCUIT

[75] Inventor: Hiroyuki Okagaki, Tokyo, Japan

[73] Assignee: Clarion Co., Ltd., Tokyo, Japan

[21] Appl. No.: 399,906

[22] Filed: Aug. 29, 1989

[30] Foreign Application Priority Data

Sep. 2, 1988 [JP] Japan ..... 63-221074

[51] Int. Cl.[5] ..... G06G 7/12

[52] U.S. Cl. ..... 364/821; 310/313 R

[58] Field of Search ..... 364/821; 310/313 R, 310/313 A, 313 B, 313 D; 333/150-155, 193-196

[56] References Cited

U.S. PATENT DOCUMENTS

| | | | |
|---|---|---|---|
| 4,037,174 | 7/1977 | Moore et al. | 364/821 |
| 4,115,865 | 9/1978 | Beaninis et al. | 364/821 |
| 4,307,616 | 12/1981 | Vasile | 364/821 |
| 4,449,193 | 5/1984 | Tournois | 364/821 |
| 4,683,395 | 7/1987 | Mitsutsuka | 364/821 |
| 4,798,988 | 1/1989 | Mitsutsuka | 364/821 |

*Primary Examiner*—Jerry Smith
*Assistant Examiner*—Jim Trammell
*Attorney, Agent, or Firm*—Wallenstein, Wagner & Hattis, Ltd.

[57] ABSTRACT

A convolver optimum bias circuit is disclosed, in which a DC bias voltage representing a phase difference between a signal corresponding to the output of an oscillator given to the gate electrode of the convolver and the output of a convolver phase circuit is applied to the gate electrode of the convolver.

11 Claims, 4 Drawing Sheets

CONVOLVER OPTIMUM BIAS CIRCUIT

FIELD OF THE INVENTION

The present invention relates to an optimum bias circuit for a convolver using surface acoustic wave (hereinbelow abbreviated to SAW).

BACKGROUND OF THE INVENTION

In a monolithic SAW convolver having a structure (piezo-electric layer/semiconductor) or (piezo-electric layer/insulator/semiconductor) or an air gap type SAW convolver having a structure (piezo-electric layer/semiconductor) or (piezo-electric layer/air/insulator/semiconductor) the convolution efficiency (hereinbelow abbreviated to $F_T$) depends generally on the bias voltage applied to the gate electrode. FIG. 4 shows an example of the relationship between the bias voltage $V_B$ and $F_T$, the capacity between the gate electrode and the earth C, as well as the conductance G in an SAW convolver having a structure ($ZnO/SiO_2/Si$).

In FIG. 4 it is shown that $F_T$ has a maximum value at a bias voltage $V_{OP}$. This bias voltage $V_{OP}$ is the optimum bias for the convolver and it is desirable that the convolver is driven always at this bias.

However, when a bias is applied to the convolver, in many cases, interfacial energy levels at the interface of semiconductor/insulator, traps at the interface of insulator/piezo-electric layer and traps in the piezo-electric layer can capture or generate electrons and holes and a fairly long time can be required for stabilizing the operation of the convolver because of the time necessary for this capture or generation. Further the relationship between the bias voltage $V_B$ and $F_T$ can depend on the history of the bias voltage applied previously thereto because of the traps and the interfacial energy levels described above. If a bias voltage different from $V_{OP}$ has been previously applied thereto, the optimum bias voltage thereafter can shift from $V_{OP}$. These phenomena are reported in "A Detailed Theory of the Monolithic Zinc Oxide on Silicon Convolver" by B. T. Khuri-Yakub and G. S. Kino, published in IEEE Transaction on Sonics and Ultrasonics, Vol. SU-24, No. Jan. 1, 1977 (USA), p, 34.

Because of the characteristics described above, heretofore a fairly long warming-up times was required after having applied the bias voltage $V_{OP}$ to the convolver until $F_T$ reaches a satisfactorily great value in order to start the convolver.

Furthermore, since the optimum bias voltage $V_{OP}$ varies depending on the temperature, by the method by which a constant bias voltage was applied to the convolver, it was difficult to drive it always with the maximum $F_T$.

For this reason, heretofore the optimum bias voltage $V_{OP}$ was applied always by means of a battery backup circuit indicated in FIG. 5. In FIG. 5 reference numeral 1 is a convolver; 2, 3 are inputs; 4 is an output gate; 5 is a battery; 6 is a thermistor; 7 is a variable resistor; 8 is an impedance; and 9 is an output. Further it was necessary that the bias voltage by means of this battery should vary so that $F_T$ of the convolver is always greatest. By this method not only the life of the battery gives rise to a problem but also it is difficult to make the gate bias voltage follow completely the variations in $V_{OP}$ with respect to the variations in the temperature. Therefore it was not possible to avoid worsening in $F_T$ of the convolver with respect to the variations in the temperature.

OBJECT OF THE INVENTION

In order to overcome the problems described above, the object of the present invention is to provide a circuit controlling the bias voltage applied to an SAW convolver so that the convolver is driven always with the greatest $F_T$.

SUMMARY OF THE INVENTION

In order to achieve the above object, a convolver optimum bias circuit according to the present invention is characterized in that it comprises a convolver; a convolver phase circuit inserted between gate electrode of the convolver and ground; an oscillator connected with the gate electrode of the convolver; a phase comparator, which compares the phase of a signal responding to the output of the convolver phase circuit stated above with a signal corresponding to the output of the oscillator stated above serving as a reference to obtain a signal representing a phase difference thus obtained; and a charge pump circuit, which transforms the signal representing the phase difference into a DC bias voltage and applies this DC bias voltage to the gate electrode of the convolver.

The present invention has been done, paying attention to the fact that the convolution output of the convolver and the impedance (admittance) of the gate electrode thereof has a very close relationship. In FIG. 4, when variations in $F_T$ are compared with characteristics of the capacity between the gate electrode and ground with respect to the bias voltage of the convolver (hereinbelow abbreviated to C-V characteristics), it can be seen that contrary to the fact that $F_T$ has a peak at a certain bias (optimum bias) voltage $V_{OP}$, the C-V characteristics vary monotonically with respect to the bias voltage. Since both the value of $F_T$ and the value of C depend on the surface state of the semiconductor, there is a close relationship between the bias characteristics of $F_T$ and the C-V characteristics and the relationships of $F_T$ and C as indicated in FIG. 4 do not vary also after having been subjected to the history of the bias voltage, which has been applied previously. That is, even if the characteristics of $F_T$ are shifted along the bias axis, the C-V characteristics are shifted in the same way and the converse is also true. Consequently the capacity $C_{OP}$ at the optimum bias voltage $V_{OP}$ remains same also after the characteristics of $F_T$ have been subjected to a history of the applied bias voltage. Therefore, if the capacity C of the gate electrode of the convolver is always monitored and the bias voltage applied thereto is so controlled that the value thereof is always equal to $C_{OP}$, it is possible to supply the convolver always with the optimum bias voltage. According to the present invention, in order to monitor the capacity C of the convolver, a phase circuit consisting of an LC band pass filter, in which an inductance is connected with the gate electrode in parallel, or a phase circuit consisting of an CR low pass filter, in which a resistor is connected with the gate electrode in series, is used to transform variations in C into variations in the phase. Further the control of the bias voltage is effected by means of the phase comparator, the charge pump and the low pass filter (LPF).

DETAILED DESCRIPTION

Figure 1:
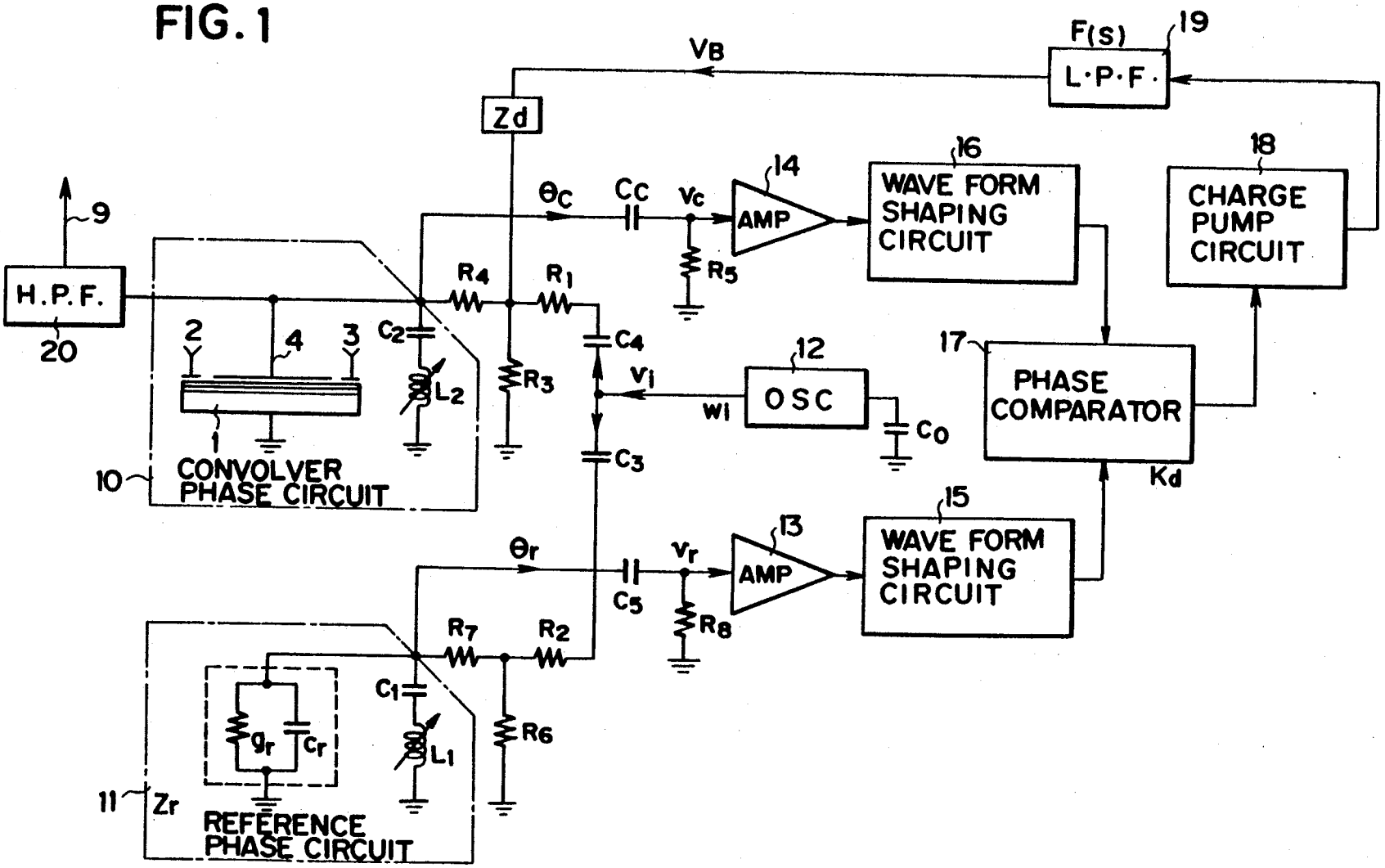
FIG. 1 is a block diagram of an SAW convolver optimum bias circuit according to the present invention.

FIG. 1 is a block diagram of an SAW convolver optimum bias circuit. This circuit is constructed by a convolver phase circuit 10 and a reference phase circuit 11 consisting respectively of series circuits composed of DC blocking capacitors $C_2$ and $C_1$ and inductances $L_2$ and $L_1$ connected with the convolver 1 and a reference impedance $Z_r$, respectively; a divider circuit using C·R dividing the output of an oscillator 12 to the convolver 1 and the reference impedance $Z_r$; amplifiers 13 and 14 amplifying the outputs of the phase circuits for the convolver 1 and the reference impedance $Z_r$, respectively; waveform shaping circuits 15 and 16 shaping waveforms of signals thus amplified into digital signals; a phase comparator 17, which compares the phase of the output signal of the phase circuit 10 including the convolver 1 with the phase of the signal outputted by the phase circuit 11 including the reference impedance $Z_r$ as the reference signal; a charge pump circuit 18, which transforms the output of the phase comparator 17 stated above into a DC bias voltage to apply it to the gate electrode of the convolver; and a low pass filter 19 determining the stability of the system.

Figure 2:
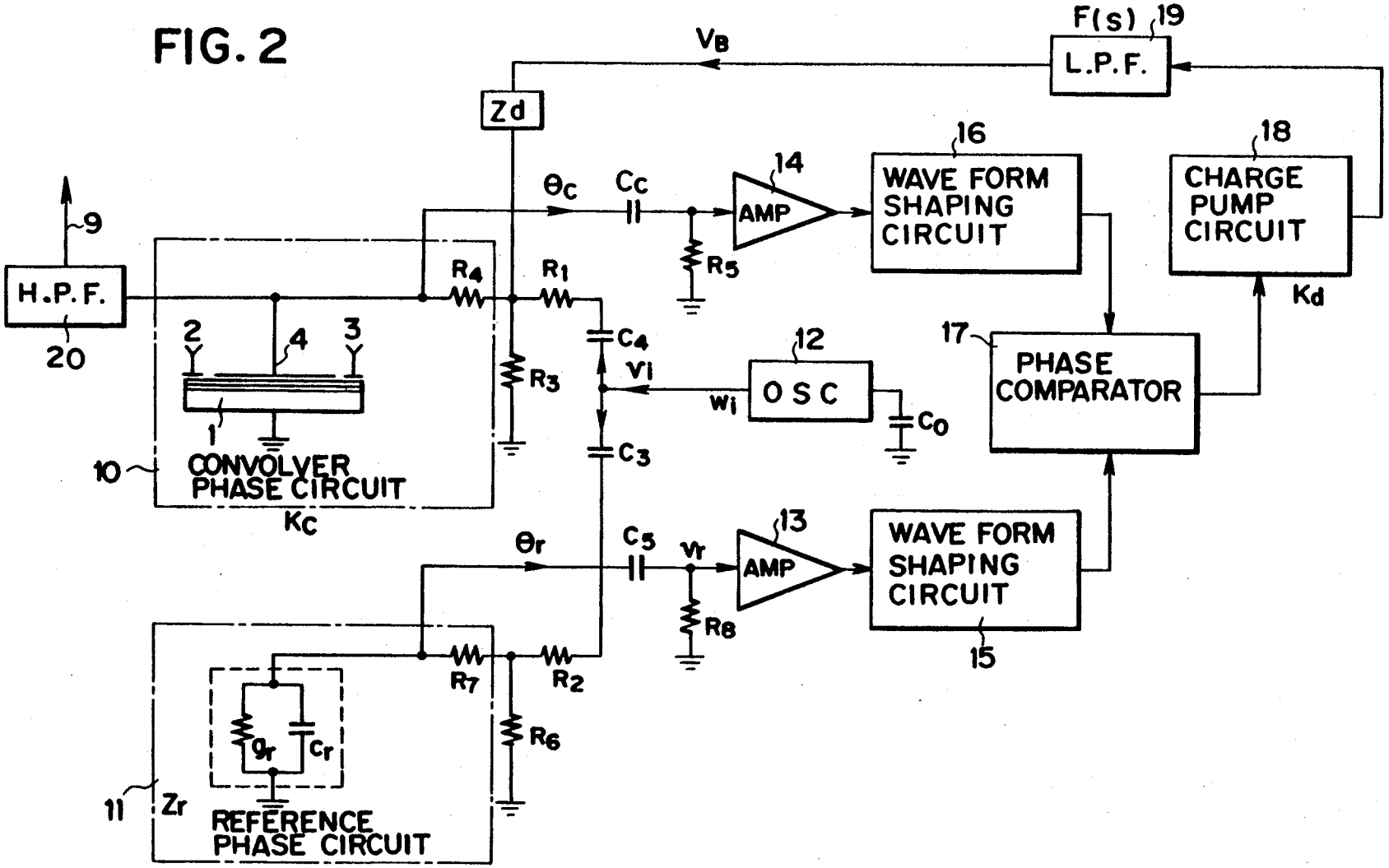
FIGS. 2 and 3 are block diagrams illustrating variations of the circuit indicated in FIG. 1.

In the circuit described above it is also possible that the convolver phase circuit 10 is constructed as a high cut type phase circuit using the convolver and a resistor and the reference phase circuit 11 is constructed similarly so as to have a phase circuit, in which a resistor is connected with the reference impedance, as indicated in FIG. 2.

Figure 3:
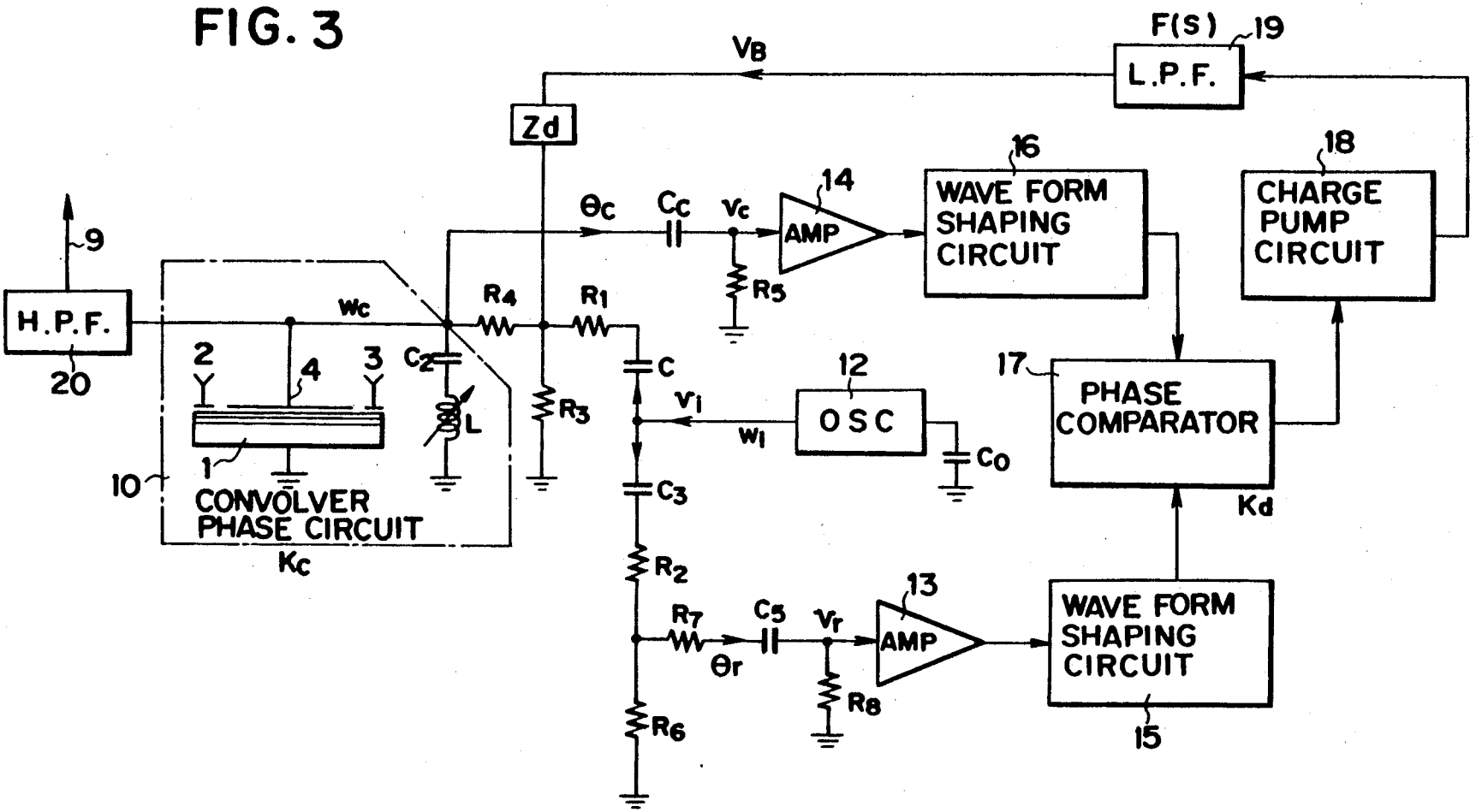
Figure 4:
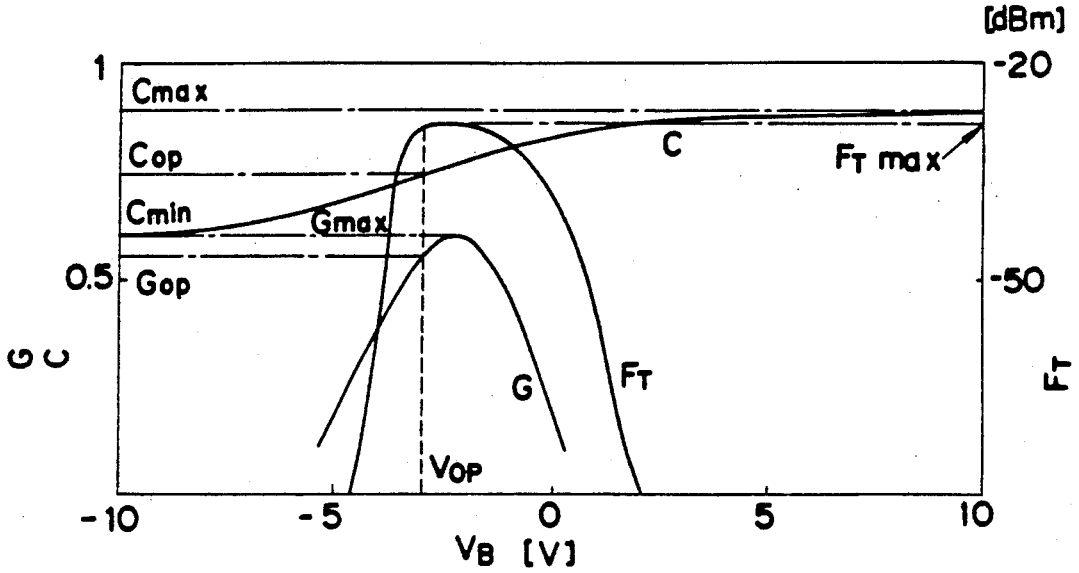
FIG. 4 is a graph indicating variations in the convolution efficiency, the capacity between the gate electrode and ground as well as the conductance with respect to the bias voltage.
Figure 5:
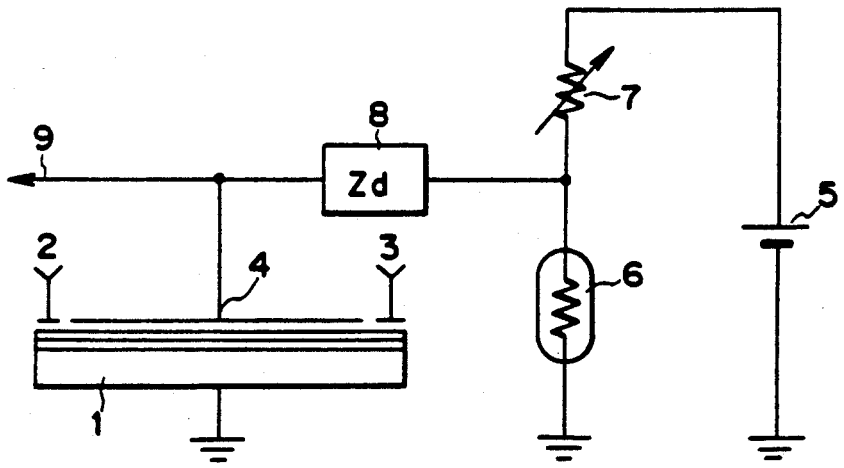
FIG. 5 PRIOR ART
FIG. 5 is a scheme showing the outline of the construction of a prior art convolver biasing circuit.

Furthermore it is possible also to remove the reference phase circuit 11 and to use the signal from the divider circuit directly through the amplifiers 13 and 14 and the waveform shaping circuits 15 and 16 for the reference signal for the phase comparator 17 to drive the circuit, as indicated in FIG. 3.

Hereinbelow the operation of the embodiments described above will be explained below.

The convolver phase circuit 10 is constructed by a grounded LC band pass filter composed of $L_2$ and $C_2$, consisting of an inductance $L_2$, with which a DC blocking capacitor $C_2$ is connected in series, the capacitor $C_2$ being connected to the gate electrode 4. In the same way the reference phase circuit 11 is constructed (FIG. 1) by an impedance circuit $Z_r$ replacingly equaling replacing equivalently the convolver and including an LC band pass filter, in which an inductance $L_1$ and a blocking DC capacitor $C_1$ are connected in series, the series pair being in parallel with the reference $Z_r$. In general, the reference impedance circuit $Z_r$ can be replaced by an impedance equivalent to the convolver, but it must not be necessarily equal thereto by a reason described later.

The resonance frequencies of the series resonance circuits consisting of the capacitors $C_2$ and $C_1$ and the inductances $L_2$ and $L_1$, are set so as to be sufficiently low so that capacitors $C_1$ and $C_2$; have no influence on the phase characteristics of the phase circuits at the oscillator frequency. Further the oscillation frequency of the oscillator (OSC) 12 is set by varying $C_0$ so as to be equal to the resonance frequency of the phase circuits and to be different from the working frequency of the convolver 1. In this way, if $C_r$ and $g_r$ of the reference phase circuit are in accordance with $C_{OP}$ and $G_{OP}$ of the convolver set at the optimum bias, respectively, when the convolver is biased at the optimum, the phase outputs of the two phase circuits are the same. Further, if the temperature characteristics of the convolver are in accordance with those of the reference impedance, the phases will remain equal, independently of variations in the oscillation frequency of the oscillator.

The output $v_i$ of the oscillator 12 is divided into an input signal for the convolver phase circuit 10 and one for the reference phase circuit 11 by means of resistors $R_1$ and $R_2$. The input signals obtained by dividing the output $v_i$ are further attenuated to a level having no influences on the output signal of the convolver by means of resistors $R_3$, $R_4$, $R_5$ and $R_6$, $R_7$, $R_8$. These divider circuits and attenuating circuits make variations in the impedance of the convolver phase circuit to have no influences on the frequency characteristics of the reference phase circuit. Capacitors $C_1$, $C_2$, $C_3$, $C_4$, $C_5$ and $C_c$ in the circuit indicated in FIG. 1 are disposed to block the DC component so that the bias voltage applied to the gate electrode 4 of the convolver 1 is not applied to the inductances, the amplifiers and the oscillator. The impedance Zd inserted between the divider output and the low pass filter 19 is disposed for making only the DC bias voltage for the convolver pass through so that the output of the convolver and the high frequency signal generated by the oscillator are not applied to the low pass filter 19.

The output of the convolver 1 is outputted through a high pass filter 20 in order to attenuate satisfactorily the input signal component $\omega_i$ of the oscillator 12 and to make only the output of the convolver 1 pass through.

The outputs of the phase circuit 10 and 11 are amplified by the amplifiers 13 and 14, shaped in waveform through the waveform shaping circuits 15 and 16, respectively, and inputted into the phase comparator 17. The phase comparator 17 compares in the phase the signal from the convolver phase circuit 10 with the signal $v_r$ serving as the reference signal from the reference phase circuit 11. The output of the phase comparator 17 is converted into a DC voltage depending on the phase difference by the charge pump circuit 18 and gives the convolver the bias voltage through the low pass filter 19 and the impedance Zd.

Now the following conditions are supposed for the sake of simplifying the explanation of the value of the reference impedance in the convolver optimum bias circuit indicated in FIG. 1.

$$g_r = G_{OP}$$

$$C_r = C_{OP}$$

$$X_{c1} = 0$$

In this case the phase $\theta_r$ of the output signal of the reference phase circuit 11 is given by;

$$\theta r = \tan^{-1} G_{op}^{-1}\left(\omega_i \cdot C_{OP} - \frac{1}{\omega_1 \cdot L_1}\right) \quad (1)$$

Further the phase $\theta_c$ of the output signal of the convolver phase circuit 10 is given by;

$$\theta c = \tan^{-1} G_{op}^{-1}\left(\omega_i \cdot C - \frac{1}{\omega_1 \cdot L_2}\right) \quad (2)$$

Denoting the conversion gain coefficient of the phase comparator 17 by Kd and the constant of the low pass filter 19 by $F_{(s)}$, the bias voltage $V_B$ applied to the convolver phase circuit is given by;

$$V_B = Kd \cdot F_{(s)} \cdot (\theta_c - \theta_r) \quad (3)$$

Denoting the conversion gain coefficient of the convolver phase circuit 10 by $K_c$, the relationship between the bias voltage $V_B$ applied to the convolver phase circuit 10 and the phase $\theta_c$ of the output signal is given by;

$$\theta_c = \theta_r + K_c \cdot V_B \quad (4)$$

Consequently the bias voltage $V_B$ of the convolver 1 is controlled so that the phase of the convolver phase circuit 10 is in accordance with the reference phase $\theta_r$ set by the reference phase circuit 11.

In this control system, putting $C_r$ and $g_r$ of the reference impedance in an equivalent circuit, which is same as that of the convolver and supposing $L_1 = L_2$, the value of the bias voltage $V_B$ when the output phases of the two phase circuits are equal to each other is necessarily equal to $G_{OP}$ by setting $C_r$ and $g_r$ at $C_{OP}$ and $V_{OP}$, respectively, i.e., at the point where the convolution efficiency $F_T$ of the convolver is greatest. Although the above explanation has been made in the case where it is supposed that $C_r = C_{OP}$, $g_r = G_{OP}$ and $L_1 = L_2$, these conditions must not be necessarily fulfilled. Since it is sufficient that the phase relations indicated by Eqs. (1) and (2) be in accordance with each other, the relation represented by the following equation is valid, and it is possible also to set arbitrarily the combination of the reference impedance or $L_1$ within the reference phase circuit 11;

$$g_r^{-1}\left(C_r - \frac{1}{L_1}\right) = G^{-1}\left(C_{OP} - \frac{1}{L_2}\right) \quad (5)$$

FIG. 3 shows a second embodiment of the present invention. The circuit indicated in FIG. 3 is a circuit, in which the reference impedance $Z_r$ in the reference phase circuit 11 is removed from the circuit indicated in FIG. 3. In this circuit one of the signals obtained by dividing the output signal is inputted directly in the phase comparator 17 as the reference signal. By this method it is possible to control stably the bias voltage for the gate electrode of the convolver with respect to temperature variations by matching variations in the frequency characteristics of the convolver phase circuit 10 with respect to temperature variations with the temperature characteristics of the oscillation frequency of the oscillator 12. Further, with respect to the first embodiment, it is possible to remove the DC blocking capacitor and the inductance within the reference phase circuit 11.

In addition, in the above description, the charge pump circuit 18 can function additionally as the low pass filter 19.

As explained above, according to the present invention, since it is possible to apply instantaneously the optimum bias to the SAW convolver and further to search automatically the optimum bias point, even if the ambient temperature varies, to follow it, it is possible to shorten remarkably the warming up time at applying the bias voltage to the SAW convolver and also to improve the temperature characteristics. Consequently, with respect to the prior art method, by which the optimum bias point for the convolver is kept always by the backup by means of a battery, it is possible to use it without paying attention to the life of a battery. Furthermore, the circuit according to the present invention can work essentially without input signal of the convolver. In addition, another advantage can be obtained that it can work without exerting any influence on the convolution output owing to the fact that the oscillation frequency of the oscillator used in the present circuit can be set independently from the working frequency of the convolver.

While particular embodiments of the invention have been shown and described, it will be obvious to those skilled in the art that various changes and modifications may be made without departing from the present invention in its broader aspect.

The embodiments of the invention in which an exclusive property or privilege is claimed are defined as follows:

1. A convolver optimum bias circuit comprising:

an oscillator;

a divider circuit for dividing an output of said oscillator to first and second outputs;

a convolver phase circuit including a convolver having a gate electrode supplied from said first output of said divider circuit, and including a first inductive impedance connected between said gate electrode and ground;

a phase comparator supplied with signals from said first and second outputs and responsive to the phase difference between said signals to provide a signal indicative of the magnitude of said phase difference; and a charge pump circuit for converting said signal indicative of the magnitude of said phase difference into a DC bias and for applying said DC bias to bias said gate electrode in a direction towards maximum convolver gain.

2. The circuit according to claim 1 including a reference phase circuit including an impedance circuit connected between said second output of said divider circuit and ground and including a second inductive impedance connected in parallel with said impedance circuit.

3. The circuit according to claim 2 wherein each of said first inductive impedance and said second inductive impedance is a circuit including a DC blocking capacitor and an inductance element which are connected in series.

4. The circuit according to claim 3 wherein at the frequency of said oscillator the inductive reactance of said inductance elements is much larger than the capacitive reactance of their associated series capacitors.

5. The circuit according to claim 1 or 2 wherein said oscillator has an oscillating frequency which is equal to a resonance frequency of said phase circuits and different from an operating frequency of said convolver.

6. The circuit according to claim 1 or 2 wherein said divider circuit includes a resistor and a capacitor connected in series to feed each of said divider outputs.

7. The circuit according to claim 1 or 2 including a low pass filter and an impedance connected in series between said charge pump circuit and said divider circuit.

8. The circuit according to claim 1 wherein said first inductive impedance is chosen to resonate with the capacitance of said gate electrode at the frequency of said oscillator when said gate capacitance is at a value equal to that at maximum convolver gain.

9. A convolver optimum bias circuit comprising:

an oscillator;

a divider circuit for dividing an output of said oscillator to first and second outputs;

a convolver phase circuit including a convolver, and including a first resistor one terminal of which is connected to a gate electrode of said convolver and the other terminal of which is supplied from said first output of said divider circuit;

a reference phase circuit including a second resistor one terminal of which is supplied from the second output, said reference phase circuit including an impedance circuit connected between said other terminal of said second resistor and ground;

a phase comparator supplied with signals from said one terminal of said first resistor and said other terminal of said second resistor and responsive to the phase difference between said signals to provide a signal indicative of the magnitude of said phase difference; and a charge pump circuit for converting said signal indicative of the magnitude of said phase difference into a DC bias and for applying said DC bias to bias said gate electrode in a direction towards maximum convolver gain.

10. The circuit according to claim 2 or 9 wherein said impedance circuit includes a resistor and a capacitor connected in parallel, and said parallel resistor and capacitor form an equivalent circuit of said convolver under conditions of maximum convolver gain.

11. The circuit according to claim 2 or 3 wherein said impedance circuit includes a resistor and a capacitor connected in parallel, said parallel resistor and capacitor form an equivalent circuit of said convolver under conditions of maximum convolver gain, said first inductive impedance has a value to resonate with the capacitance of said gate electrode at the frequency of said oscillator when said gate capacitance is at a value equal to that at maximum convolver gain, and said second inductive impedance has a value to resonate with said impedance circuit capacitor at the frequency of said oscillator.

* * * * *